US008636123B2

(12) United States Patent
Santy et al.

(10) Patent No.: US 8,636,123 B2
(45) Date of Patent: Jan. 28, 2014

(54) LUGGAGE PANEL WITH INTEGRATED CARRY HANDLE FOR SOFT-SIDE TYPE LUGGAGE CASES

(75) Inventors: Dirk Santy, Koekelare (BE); Joris Smeuninx, Ghent (BE); George Teixeira, Warren, RI (US); Kenzo Yoneno, Wan Chai (HK)

(73) Assignee: Samsonite IP Holdings S.a.r.l., Luxembourg (LU)

( * ) Notice: Subject to any disclaimer, the term of this patent is extended or adjusted under 35 U.S.C. 154(b) by 377 days.

(21) Appl. No.: 12/908,761

(22) Filed: Oct. 20, 2010

(65) Prior Publication Data

US 2011/0088987 A1 Apr. 21, 2011

Related U.S. Application Data

(60) Provisional application No. 61/253,242, filed on Oct. 20, 2009.

(51) Int. Cl.
*A47B 95/02* (2006.01)

(52) U.S. Cl.
USPC ..... 190/115; 190/100; 190/126; 190/127; 190/18 A; 190/24; 206/320; 16/407; 16/114.1

(58) Field of Classification Search
USPC ..... 190/100, 115, 126, 127, 18 A, 24; 206/320; 16/407, 114.1
See application file for complete search history.

(56) References Cited

U.S. PATENT DOCUMENTS 1,808,375 A 6/1931 Plooster
1,908,926 A 5/1933 Severance
2,059,621 A * 11/1936 Belcher ..... 16/407
2,277,976 A 3/1942 Helmenstine
2,394,782 A 2/1946 Kalske
2,723,027 A 11/1955 Guyer
2,868,433 A 1/1959 Anderson, Jr.
4,298,104 A 11/1981 Leong
4,436,244 A 3/1984 Morris (Continued)

FOREIGN PATENT DOCUMENTS

DE 3205340 A1 8/1983
DE 8428169.3 U1 11/1984

(Continued)

OTHER PUBLICATIONS

International Search Report of corresponding International Application No. PCT/US2010/053429, dated Dec. 21, 2010, 3 pages.

(Continued)

*Primary Examiner* — Anthony Stashick
*Assistant Examiner* — Cynthia Collado
(74) *Attorney, Agent, or Firm* — Dorsey & Whitney LLP

(57) ABSTRACT

Luggage cases of the soft-side construction are perceived to be lighter than hard-side cases. However, many rigidifying elements in soft-side cases tend to add to the weight of a soft-side luggage case. This reduces its weight advantage over molded shell luggage cases. Using a textile body in the luggage case to form both the grip of a carry handle and a portion of the outer surface of the luggage helps reduce the weight of the luggage. The textile body may be attached to a thin resilient wire hoop to resist distortion of the luggage case when is it lifted by the handle. This construction saves weight in comparison to conventional luggage case constructions.

24 Claims, 13 Drawing Sheets

(56) References Cited

U.S. PATENT DOCUMENTS

| | | | | |
|---|---|---|---|---|
| 4,539,705 | A | 9/1985 | Baines | |
| 4,573,203 | A | 2/1986 | Peppiatt | |
| 4,598,802 | A * | 7/1986 | Abenaim | 190/107 |
| 4,782,556 | A | 11/1988 | Kim | |
| D302,077 | S | 7/1989 | Kim | |
| 4,867,575 | A * | 9/1989 | Wood | 383/17 |
| 4,874,255 | A | 10/1989 | Ball et al. | |
| 4,874,256 | A | 10/1989 | Baines | |
| D315,285 | S | 3/1991 | Workman | |
| 5,036,978 | A | 8/1991 | Frank et al. | |
| 5,054,619 | A | 10/1991 | Muckenfuhs | |
| 5,071,260 | A | 12/1991 | Poppe et al. | |
| 5,121,995 | A | 6/1992 | Newman et al. | |
| 5,252,161 | A | 10/1993 | Chang et al. | |
| 5,282,687 | A | 2/1994 | Yee | |
| 5,427,241 | A | 6/1995 | Sutherland | |
| D368,371 | S | 4/1996 | Calmeise | |
| D372,796 | S | 8/1996 | Ferris | |
| D380,298 | S | 7/1997 | Ferris | |
| D419,853 | S | 2/2000 | Workman et al. | |
| 6,044,879 | A | 4/2000 | Ray | |
| 6,098,768 | A * | 8/2000 | Tsai | 190/18 A |
| 6,109,404 | A * | 8/2000 | Bishop | 190/125 |
| D437,202 | S | 2/2001 | O'Neil | |
| 6,247,203 | B1 | 6/2001 | Kuo | |
| 6,302,319 | B1 | 10/2001 | Peeples et al. | |
| D456,135 | S | 4/2002 | Shapiro | |
| D460,618 | S | 7/2002 | Szyf | |
| D460,677 | S | 7/2002 | Proot et al. | |
| D461,055 | S | 8/2002 | Szyf | |
| D468,534 | S | 1/2003 | Crandall | |
| 6,502,677 | B1 * | 1/2003 | Tiramani et al. | 190/127 |
| 6,612,413 | B2 * | 9/2003 | Kuwayama | 190/127 |
| 6,612,802 | B2 * | 9/2003 | Egan | 414/539 |
| 6,874,604 | B2 | 4/2005 | Miller et al. | |
| D507,734 | S | 7/2005 | Willems | |
| D526,784 | S | 8/2006 | Proot | |
| D528,301 | S | 9/2006 | Proot et al. | |
| D554,372 | S | 11/2007 | Scicluna et al. | |
| D571,103 | S | 6/2008 | Simonian et al. | |
| 7,392,888 | B2 * | 7/2008 | Lai | 190/126 |
| D600,095 | S | 9/2009 | Mattson et al. | |
| 7,690,503 | B2 | 4/2010 | Foster et al. | |
| 7,806,314 | B2 | 10/2010 | Sutherland | |
| 7,900,758 | B2 * | 3/2011 | King et al. | 190/112 |
| 7,909,161 | B2 * | 3/2011 | Sween et al. | 206/320 |
| D639,063 | S | 6/2011 | Benoit | |
| D643,214 | S | 8/2011 | Weedon et al. | |
| 8,032,986 | B2 * | 10/2011 | Lawrence | 16/114.1 |
| D650,584 | S | 12/2011 | Kim | |
| D678,678 | S | 3/2013 | Santy et al. | |
| 2001/0034923 | A1 | 11/2001 | Ho | |
| 2001/0037923 | A1 | 11/2001 | Godshaw | |
| 2003/0099503 | A1 | 5/2003 | Moor | |
| 2004/0070242 | A1 | 4/2004 | Illulian | |
| 2004/0182667 | A1 | 9/2004 | Lin | |
| 2005/0263364 | A1 | 12/2005 | Sher | |
| 2006/0064852 | A1 | 3/2006 | Willems | |
| 2006/0137951 | A1 * | 6/2006 | Lai | 190/127 |
| 2008/0199107 | A1 | 8/2008 | Nicholson | |
| 2009/0022430 | A1 | 1/2009 | Hutchison et al. | |
| 2011/0088987 | A1 * | 4/2011 | Santy et al. | 190/115 |

FOREIGN PATENT DOCUMENTS

| | | | |
|---|---|---|---|
| DE | 20300644 | U1 | 5/2004 |
| DE | 202005013492 | U1 | 1/2006 |
| EM | 000036710-0006 | | 5/2003 |
| EM | 000036710-0007 | | 5/2003 |
| EM | 000036710-0009 | | 5/2003 |
| EM | 001625757-0001 | | 10/2009 |
| EM | 001199392-0002 | | 3/2010 |
| EM | 001199392-0003 | | 3/2010 |
| EM | 001241350-0001 | | 10/2010 |
| EM | 001241350-0002 | | 10/2010 |
| EM | 001241368-0001 | | 10/2010 |
| EM | 001245369-0001 | | 11/2010 |
| EM | 001245369-0002 | | 11/2010 |
| EM | 001261903-0001 | | 2/2011 |
| EM | 001261903-0002 | | 2/2011 |
| EM | 001261903-0003 | | 2/2011 |
| EM | 001261903-0004 | | 2/2011 |
| EM | 001901539-0001 | | 8/2011 |
| EM | 001905993-0001 | | 9/2011 |
| EM | 001935743-0001 | | 10/2011 |
| EM | 001935743-0002 | | 10/2011 |
| EM | 001935743-0003 | | 10/2011 |
| EM | 001947599-0001 | | 11/2011 |
| EM | 001947599-0002 | | 11/2011 |
| EM | 001947599-0003 | | 11/2011 |
| EM | 002024737-0001 | | 4/2012 |
| EM | 002024737-0002 | | 4/2012 |
| EP | 0553693 | A2 | 8/1993 |
| EP | 1777167 | A1 | 4/2007 |
| EP | 2363037 | | 9/2011 |
| FR | 2013083 | A1 | 3/1970 |
| FR | 2053590 | A5 | 4/1971 |
| GB | 3008506 | | 11/2002 |
| GB | 3014894 | | 10/2003 |
| WO | 9321078 | A1 | 10/1993 |
| WO | 2008038308 | A1 | 4/2008 |
| WO | 2008098116 | A1 | 8/2008 |

OTHER PUBLICATIONS

Airport Security, Feb. 16, 2006; available at http://web.archive.org/web/20060216002117/http://thinktankphoto.com/ttp_product_ArprtScrty.php (chart; follow "Next>>").

Graf von Stosch et al., Opposition filed against European Patent No. 2 405 783 (10 825 624.9), dated Apr. 24, 2013, 99 pages.

Author Unknown, "Delsey trolley 'FIBER LITE'", product offered for sale in Kaufhof department stores as early as Apr. 2009, 4 pages.

Author Unknown, "Crumpler bag 'Company Gigolo 3500'", product sold in stores and on-line in Germany since Aug. 2009, 4 pages.

Product Page from amazon.de, "Crumpler 3500 Company Gigolo Kameratasche braun", based on product information listed on the web page, product was available from Amazon Germany as early as Sep. 8, 2009, 4 pages.

Author Unknown, "Stratic trolley 'VIVA'", product appears to have been available through Kaufhof Warenhaus AG as early as Apr. 11, 2002, 3 pages.

Author Unknown, "Stratic" Catalog, "Viva", (date unknown), 5 pages.

Product Page from amazon.de, "Stratic Trolley AGRAVIC, 57 cm, S", based on product information listed on the web page, product was available from Amazon Germany as early as Jul. 28, 2010, 4 pages.

Author Unknown, "Stratic trolley 'Agravic'", presented to the public at the trade fair I.L.M Summer Styles in Sep. 2010 in Offenbach, Germany, 8 pages.

Andrees, "Observation/objection by a third party according to Rule 114(1) EPC", Letter from Dr. Lars Christian Andrees dated Feb. 18, 2013, 16 pages.

Author Unknown, "Delsey Fiber Lite", (date unknown), 1 page.

Author Unknown, Luggage Case Submitted by Saxoline/Navigator /Brington "Saxoline Luggage", (date unknown), 1 page.

Author Unknown, "Travelite" catalog, 2007, 7 pages.

Author Unknown, "Crumpler Cork and Fork Roll-on, Roll-off Photo Luggage with removable backpack insert", Reference found at http://www.flickr.com/photos/bigbadbenny/sets/72157604256758213, at least as early as Mar. 2008, 5 pages.

* cited by examiner

LUGGAGE PANEL WITH INTEGRATED CARRY HANDLE FOR SOFT-SIDE TYPE LUGGAGE CASES

CROSS-REFERENCE TO RELATED APPLICATIONS

This application claims the benefit under 35 U.S.C. §119 (e) to U.S. provisional application No. 61/253,242, entitled "Lightweight Top and Side Panel Carry Handle Construction for Soft-Side Type Luggage Cases" and filed on Oct. 20, 2009, which is hereby incorporated herein by reference in its entirety.

FIELD OF INVENTION

The field of invention generally relates to luggage.

BACKGROUND

Luggage cases or the like may include two or more wheels mounted on or next to the bottom panel of such luggage cases to facilitate transportation of the luggage cases by dragging or pushing the luggage cases. Even when such luggage cases include this convenient wheeling system, it may be necessary to lift or carry the case by hand. For example, placing the luggage case in the trunk or passenger compartment of a vehicle or transferring the luggage to or from a luggage carousel in an airport or the like may require the luggage case to be lifted or carried. Any handles or grips for such purposes should be quite strong since each handle must support the weight of the luggage case when it is filled with a traveler's belongings. Also, for a structured soft-side luggage case, the panel to which the carry handle is attached must be sturdy enough to not significantly distort the shape of the case when the filled luggage is carried by the handle.

Another challenge for making such luggage cases is that the purchaser often lifts luggage cases when shopping for luggage to determine the sturdiness and weight of the luggage case. Of course these luggage cases on display in the luggage shop are empty. Also one measure used by luggage retailers and manufacturers to sell luggage is the empty weight of the luggage case expressed in kilograms or pounds. Thus, a criteria for buying a luggage case is the weight of the luggage case, even though the empty weight of the luggage case usually amounts to a small percentage of the weight of the case when packed for travel.

Also, when lifting the empty luggage case to judge its weight, the prospective luggage purchaser must decide whether the luggage construction is sturdy enough to withstand the rigors of travel. It is this conflict or dichotomy, the lightness of an empty luggage case and perceived robustness or durability of the case, that luggage manufacturers have grappled with for decades.

SUMMARY

One embodiment of a luggage case may include a panel with a carry handle integrated therewith. The panel may include a generally flat sheet of flexible laminar body material that constitutes the bulk of the outside surface of the soft-side luggage case, The luggage case may further include a resilient hoop positioned around the perimeter of the panel. A resilient hoop may be firmly attached to the flexible laminar body material. In some embodiments, this body material is firmly attached to at least a majority of the hoop. Two side portions of the flat sheet may be reduced in dimension to form a handle grip located generally in the center of the sheet. Beneath this grip may be a second sheet of a flexible laminar material, preferably also of body material, affixed at its edges to the remaining portions of the perimeter wire hoop exposed by the narrowed portion of laminar body material that defines the handle grip.

Another embodiment of a luggage case may include a first panel. The first panel may include a perimeter edge. The first panel may define at least a portion of an outer surface of the luggage. The first panel may include a first textile body. The first textile body may define at least a portion of an outer surface of the first panel. The first textile body may further define at least a portion of the perimeter edge of the first panel. The first textile body may include a grip portion defining a grip for a carry handle.

DETAILED DESCRIPTION

Figure 1:
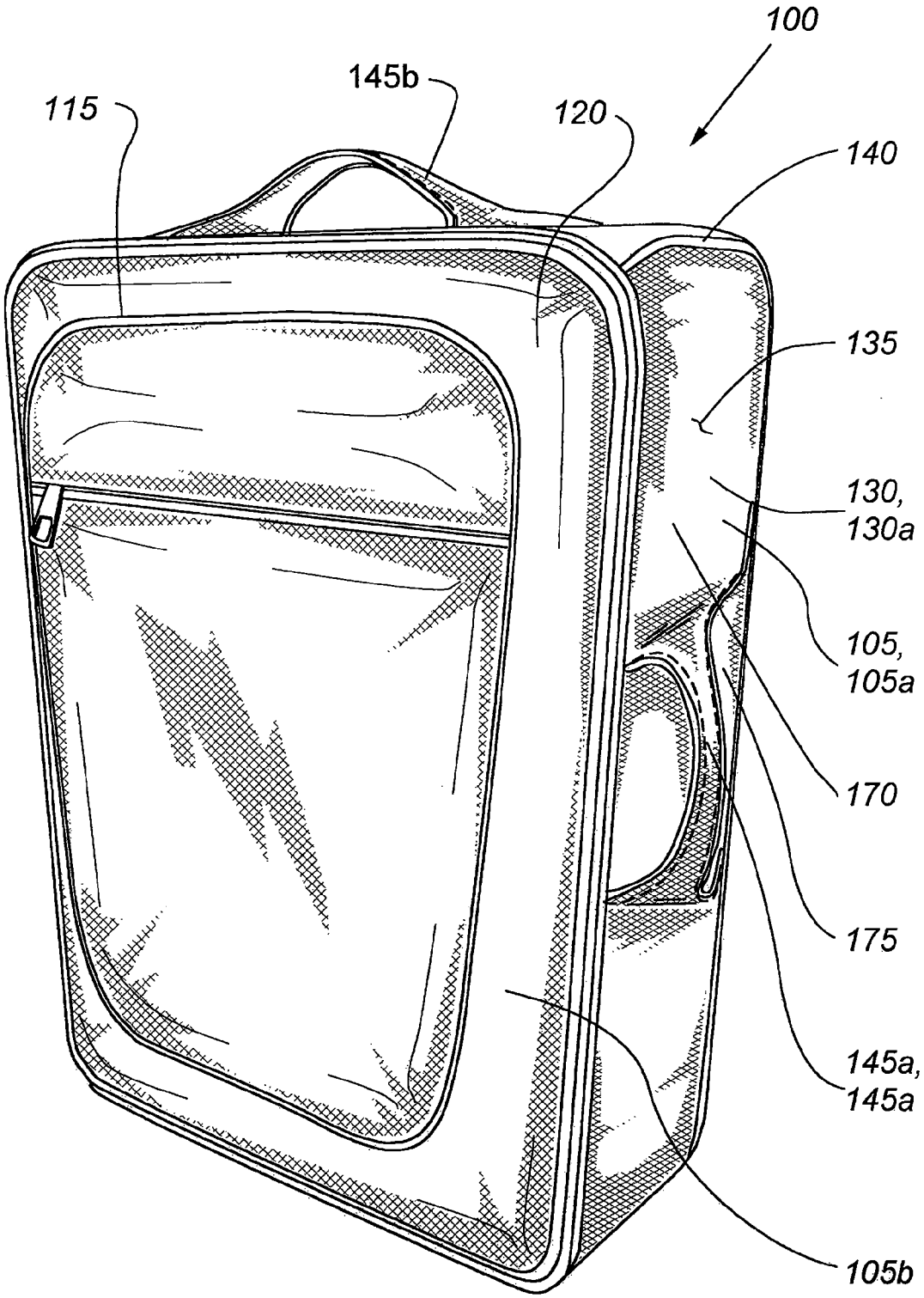
FIG. 1 is a perspective view of an upright luggage case showing top and side panels, each incorporating a carry-handle formed from the material defining the outer surfaces of the panels.
Figure 2:
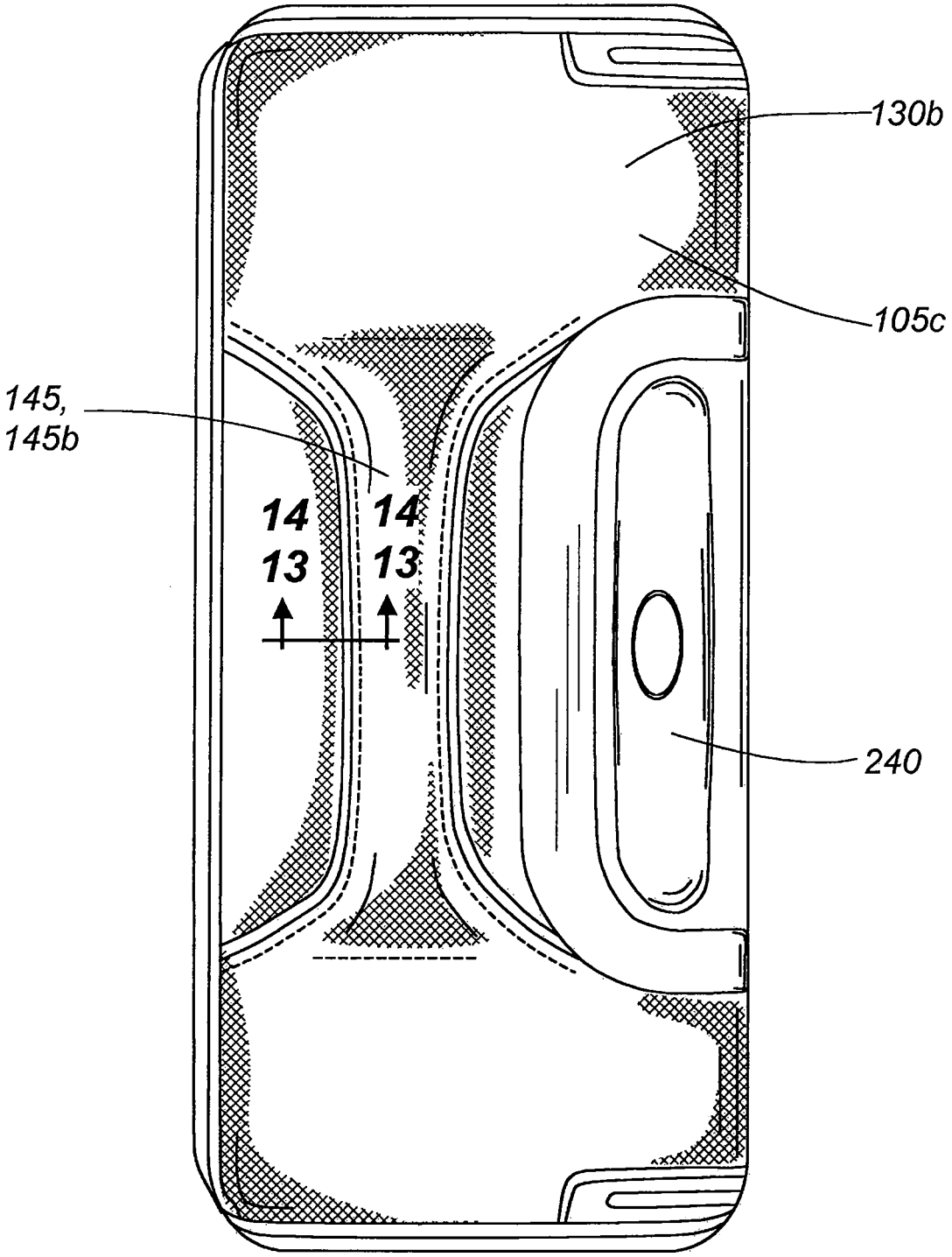
FIG. 2 is a top view of the luggage case shown in FIG. 1, showing the top panel with the carrying handle and a telescopic wheel handle.

Described herein are methods for making structured but essentially soft-sided luggage cases, and products created using such methods. These cases are usually formed from textile panels, leather panels or simulated leather panels. These cases may include other components, such as frames, boards, and so on, that are intended to hold the otherwise flimsy panels in a generally flat rectangular shape to form a luggage case with an overall parallelepiped shape. More particularly, described herein is a particularly lightweight construction for those panels that also serves to mount a carry handle for manually carrying or towing the luggage case during travel, etc. The construction methods include making rectangular, or other shaped, panels with integrated carrying handled for luggage cases, such as upright or spinner type cases, or the like (e.g., duffel bags, backpacks, and so on) where one mode for transporting the luggage case is to drag or push the luggage case on two or more wheels mounted on or next to the bottom panel of such luggage case. In constructing such panels, minimal or no rigid stiffening structures may be used to reduce to weight of the style luggage case. Such a light construction may contribute to the overall light weight of the empty case, while demonstrating that the case is robust and dimensionally stable.

In describing the components of the luggage and alternative versions, or embodiments, of some of these components, the same reference number may be used for elements that are the same as, or similar to, elements described in other versions or embodiments.

Turning to FIGS. 1-4, a luggage case 100 may include one or more sides 105. In some embodiments, the luggage case may include six sides 105*a-c* (e.g., top, bottom, left, right, front and back sides). Other embodiments of the luggage case 100 may include more or less than six sides. The sides 105 of the luggage case 100 may define a main packing compartment. Each side 105 may have a generally rectangular shape to form a generally parallelepiped luggage case 100. In some embodiments, the sides 105 may have other shapes to define a luggage case 100 with a desired shape other than generally parallelepiped. The luggage case 100 may further includes wheels 110, glides, edge piping 115 to help protect the outer surface of the luggage from scuffs and abrasions, and a main door 120 with a perimeter zipper 125 for access to at least the main packing compartment.

Each side 105 of the luggage case 100 may be formed using one or more panels 130. In some embodiments, each side 105 of the luggage case 100 may be formed using a single panel 130. In other embodiments, two or more panels 130 may be used to form a side 105 of the luggage case 100. At least some of the panels 130 forming the sides 105 of the luggage case 100 may define at least a portion of the outer surface 135 of the luggage case 100. For example, with reference to FIG. 1, the side and top panels 130*a,b* define a portion of the outer surface 135 of the luggage case 100. At least some of the panels 130 may be joined to an adjacent panel 130 proximate a perimeter edge 140 of the panel 130. For example, with reference to FIG. 1, a first panel 130*a* (e.g., a side panel) may be joined a second panel 130*b* (e.g., a top panel) proximate a perimeter edge 140 of the first panel 130*a* (e.g., the upper edge of the side panel).

The luggage case 100 may further include carry handles 145 integrally joined with the one or more panels 130 that define the sides 105 of the luggage case 100. With reference to FIG. 1, the side panel 105*a* and the top panel 105*b* of the luggage case may each include a carry handle 145*a,b* integrally joined with its respective panel 130*a,b*. While the carry handles 145 are shown as integrally joined with the top and side panels 130, a carry handle 145 may be integrally joined with any panel 130 defining a side 105 of the luggage case 100.

Figure 3A:
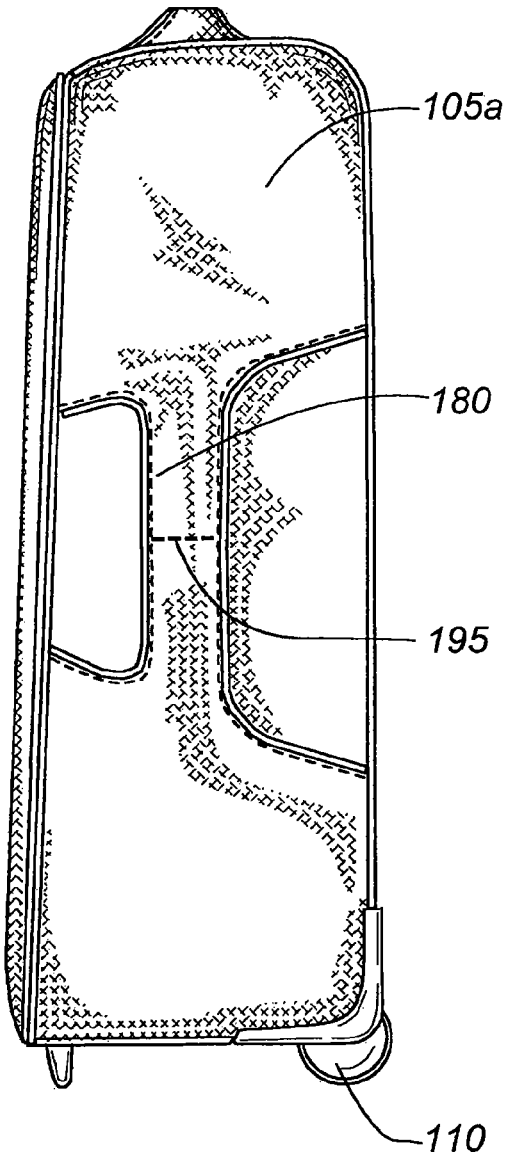
FIG. 3A shows an elevation view of the luggage case shown in FIG. 1, showing one possible way to form a first textile body for the side panel.
Figure 3B:
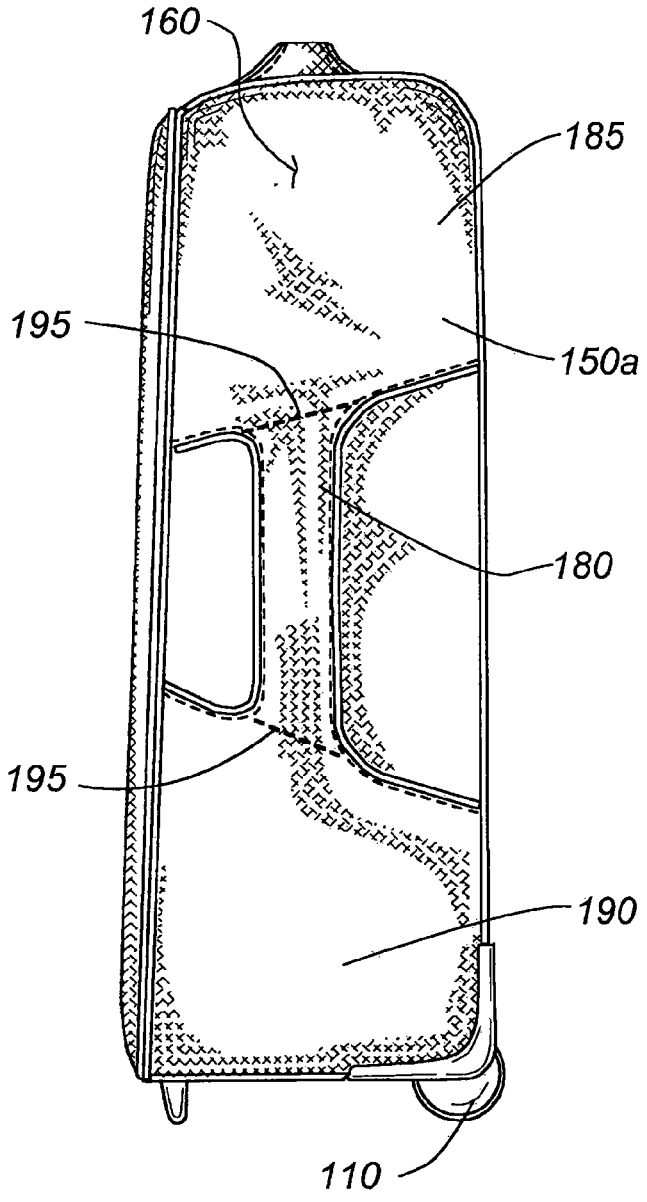
FIG. 3B shows an elevation view of the luggage case shown in FIG. 1, showing another possible way to form a first textile body for the side panel.
Figure 4:
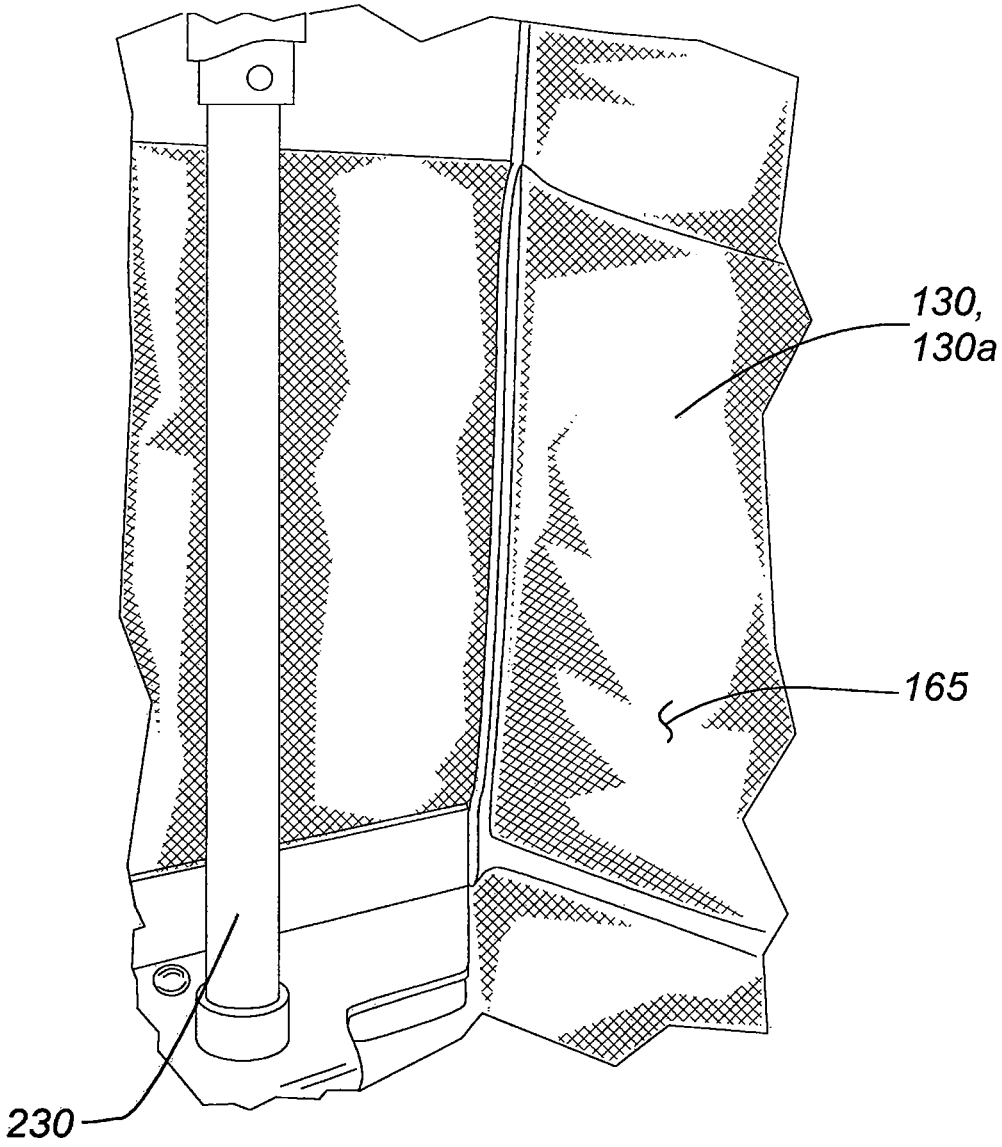
FIG. 4 shows, through the open main packing door, interior surfaces of the luggage case shown in FIG. 1.
Figure 5:
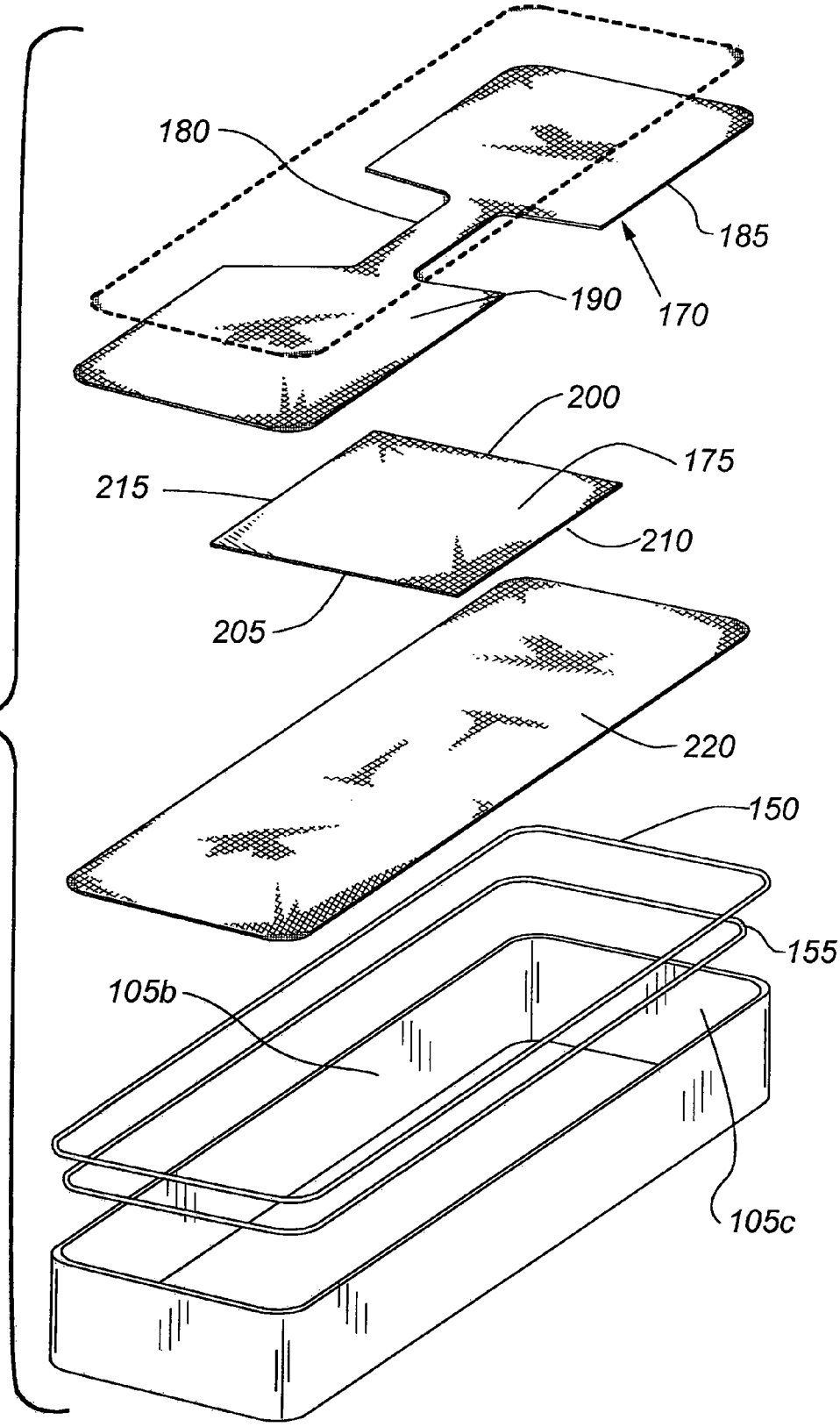
FIG. 5 is a schematic exploded view of the structural components of the side panel for the luggage case shown in FIG. 1.
Figure 6:
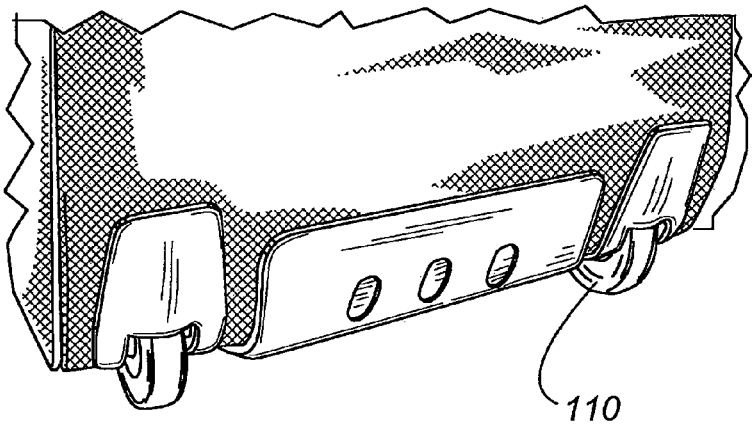
FIG. 6 is a partial perspective view of the luggage case of FIG. 1, showing the wheels mounted on the lower end of the luggage case.
Figure 7:
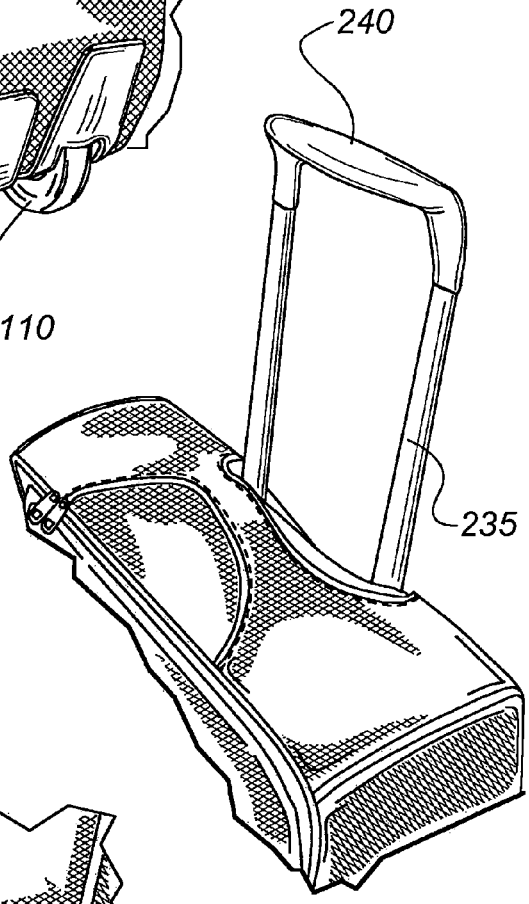
FIG. 7 is another partial perspective view of the luggage case of FIG. 1, showing the telescopic wheel handle in an extended position.

The following description of forming the carry handle 145 on a panel 130 will be described with respect to the side panel 130*a*. However, this description should be understood as applicable for the top panel 130*b*, or any other panel 130, that incorporates an integral handle. With reference to FIGS. 1, 3A and 5, the side panel 130*a* may include perimeter edge 140 to which one or more other panels 130 may be attached. While the other panels 130 are typically attached to the side panel 130*a* by sewing, any suitable connection method may be used to join the panels 130 together. A reinforcement assemblage may be positioned proximate the perimeter edge 140 of the side panel. The reinforcement assemblage may include an edge beading 150 and a generally rectangular frame or hoop 155 of a resilient, tough steel wire or similar material. The hoop 155 may be resilient, flexible and resistant to compression but may also be bendable and flexible, especially along its longer straight sides unless constrained. The hoop 155 may be positioned within a substantially enclosed space defined by the edge beading.

The side panel 130*a* may include the perimeter edge 140, an outer surface 160 and an inner surface 165. The perimeter edge 140 may define a rectangular shape, or any other desired shape. The outer surface 160 may be constructed using a first textile body 170 and a second textile body 175. The first and second textile bodies 170, 175 may be formed from a robust woven textile, such as nylon, polyester, Ramie or the like.

The first textile body 170 may be generally rectangular in shape, or any other shape that generally matches at least a portion of the shape defined by the perimeter 140 edge of the side panel 130*a*. A central or grip portion 180 of the first textile body 170 may define a relatively narrow band of material between first and second portions 185, 190 of the first textile body 170. The relatively narrow band of material defines the grip for the carry handle 145*a*. The first and second portions 185, 190 may be formed at end or outer portions of the first textile body 170. The central or grip portion 180 may be smoothly and integrally joined to the first and second portions 185, 190 of the first textile body 170 by way of curved edges. Each first and second portion 185, 190 of the first textile body 170 may widen from a relative narrow dimension proximate the central or grip portion 180 to the full width dimension of the generally rectangular side panel 130*a*.

Figure 10:
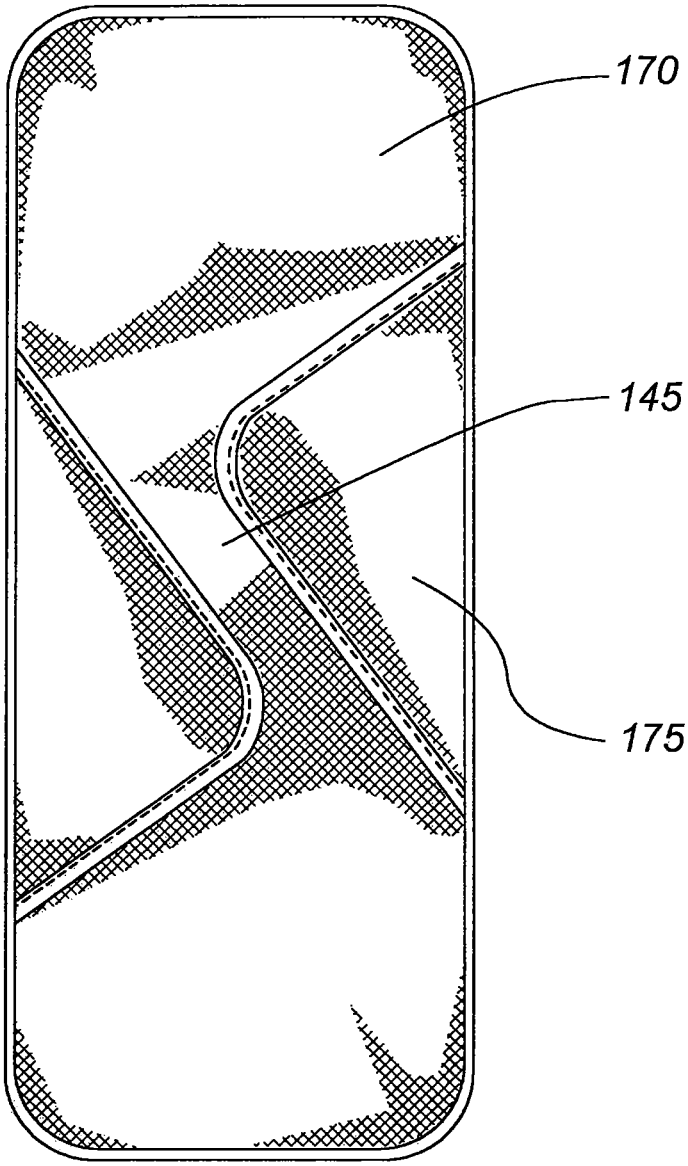
FIG. 10 shows a top view of a panel for a luggage case, showing another version of incorporating a handle into the panel.

In some embodiments, the central or grip portion 180 of the first textile body 170 defines a handle grip with a longitudinal axis that is relatively transverse to an edge defining the width of the first and second portions and/or the panel. Such a configuration is shown, for example, in FIGS. 2, 3A and 3B. In other embodiments, the handle grip may have a longitudinal axis that is positioned at an angle relative to the edge defining the width of the first and second portions and/or the panel. Such as configuration is shown, for example, in FIG. 10. The foregoing examples are merely illustrative of how the handle may be positioned relative to the first and second portions 185, 190 of the first textile body 170 and/or the side panel 130*a*. Other configurations of the handle relative to the first and second portions 130*a,b* of the first textile body and/or the panel may be defined in the central or grip portion 180 of the first textile body 170 so long as the handle is formed from a first textile body 170 that defines at least a portion of the outer surface 135 of the side panel 130*a*.

As shown, for example, in FIGS. 1 and 5, the first textile body 170 in some embodiments may be made from a single piece of textile material. In such embodiments, the central or grip portion 180 may be formed by cutting material within the central or grip portion 180 of the single piece of textile material to define the narrow band of material. The cut edges created in the central or grip portion 180 may be finished either by folding the edges or by applying an edge beading or trim. In other such embodiments, the first, second and central (or grip) portions 180, 185, 190 could be defined when creating the piece of textile material used for the first textile body 170.

In some embodiments, the first textile body 170 may formed using two or more pieces of textile material. For example, with reference to FIG. 3A, two pieces of textile material joined by a seam 195 positioned proximate a centerline of the central or grip portion 180 may be utilized to form the first textile body 170. Such a construction for the first textile body 170 may result in an overall saving in textile material compared to forming the first textile body 170 from a single piece of textile material. As another example, with reference to FIG. 3B, three pieces of textile material may be joined by seams 195 to form the first textile body 170. One piece may be used to form the central or grip portion 180 of the first textile body, and the other two pieces may be used to form the first and second portions 185, 190 of the first textile body 170. Such a construction may result in further material savings compared to using a single piece of material and also would permit the use of a contrasting color or texture choice for the central or grip portion 180 of the first textile body 170. Such a contrasting material choice may have aesthetic and functional advantages.

The foregoing examples are merely illustrative of some ways that the first textile body 170 may be formed, and are not intended to limit how the first textile body 170 may be formed. Further, while described as being formed using one, two or three pieces of textile material, any number of pieces of textile material may be use to created the first textile body 170.

The first and second portions 185, 190 of the first textile body 170 may be joined to the edge beading 150. The first and second portions 185, 190 may be joined to the edge beading 150 by stitching the first and second portions 185,190 along at least a portion of their edges to the edge beading 150, or by using any other suitable connection method, including, but not limited to, adhering or bonding the first and second portions 185, 190 to the edge beading 150. This joining of the first and second portions 185,190 of the first textile body 170 to the edge beading 150 functions to operatively connect the first textile body 170 with the hoop 155.

The second textile body 175 may be generally square or rectangular in shape. The second textile body 175 may be positioned underneath the central or grip portion 180 of the first textile body 170. The second textile body 175 may include two edges, which may be referred to as first and second edges 200, 205, that each span the width of the first and second portions 185, 190 of the first textile body 170, and two other edges, which may be referred to as third and fourth edges 210, 215, that span at least the length of the central or grip portion 180 of the first textile body 170. In some embodiments, the third and fourth edges 210, 215 may end proximate the perimeter edge 140 of the side panel 130*a*. The first and second edges 200, 205 may be joined to the first textile body 170 by a suitable connection method, such as stitching or bonding. The third and fourth edges 210, 215 may be joined to the perimeter edge 140 of the panel 130*a* by a suitable connection method, such as stitching or bonding. Together, the first and second textile bodies 170, 175 may define substantially the entire outer surface 135 of the side panel 130*a*. Portions of the edges of the first and second textile bodies 170, 175 may also collectively define the perimeter edge 140 of the side panel 130*a*.

The inner surface 165 of the panel may be formed using a lining material 220. This lining material 220 may be a textile material that is fairly light and smooth to give a pleasing interior texture and finished look to the luggage case 100. The lining material 220 is not necessary from a structural standpoint. Thus, the lining material 220 may be omitted, if desired. In such embodiments, the first and second textile bodies 170, 175 may define the inner surface 165 of the side panel 130*a*.

Once constructed, the lifting force from the handle grip (i.e., the central or grip portion 180 of the first textile body 170) may transferred by way of the first and second portions 185, 190 of the first textile body 170 to the perimeter edge 140 of the side panel 130*a*. In particular, the lifting force may result in horizontal and vertical forces being imposed on the perimeter edge 140 of the side panel 130*a*. The horizontal forces may generally result in compressive forces applied along the longitudinal axes of the hoop 155. The vertical forces may generally result in the rest of the luggage case and its contents hanging from the hoop 155. Thus, the hoop 155 helps to minimize the distortion of the side panel 130*a* with the integrated carry handle 145*a*. This, in turn, helps to maintain the overall shape of the luggage case 100 when carried by the carry handle 145*a*. Both the horizontal and vertical forces applied to the hoop 155 may be relatively uniform, which may further help to minimize the distortion of the side panel 130*a* with the integrated carry handle 145*a*.

Because of the lack of further rigid structures under it, the panels 130 that incorporate the integrated carry handle 145 are relatively light. As a result of this construction, the prospective purchaser may perceive the luggage case 100 to be strong enough to withstand the rigors of travel, while also appreciating it as being lighter than conventional luggage constructions.

Figure 11:
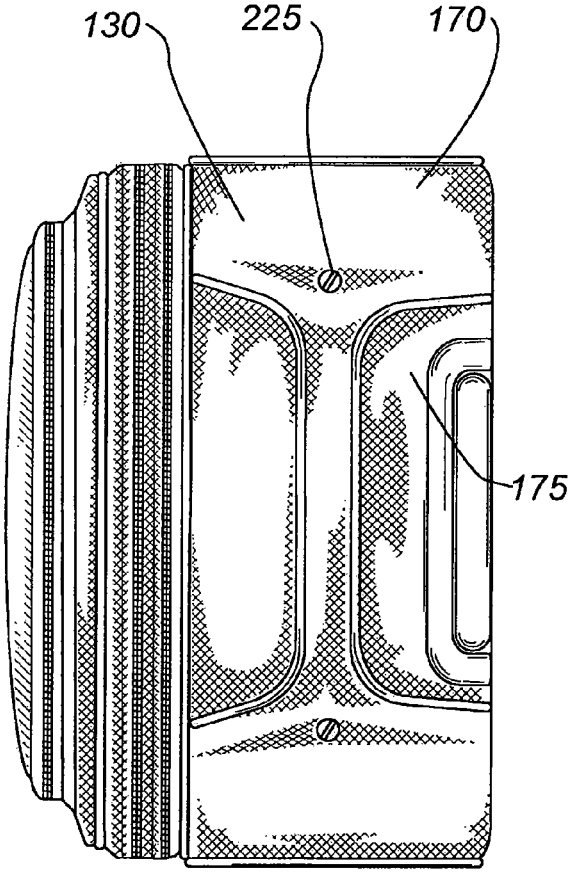
FIG. 11 shows a top view a luggage case similar to the luggage case shown in FIG. 1, showing a top panel that has both an integrated carry handle and rivets.
Figure 12:
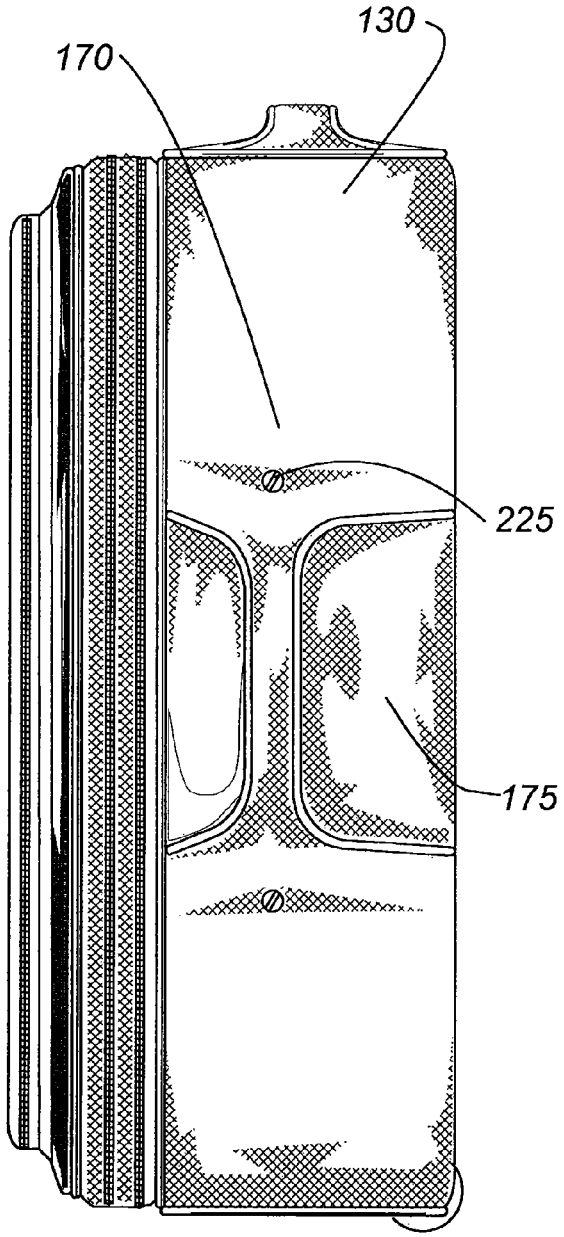
FIG. 12 shows a side view a luggage case similar to the luggage case shown in FIG. 1, showing a side panel that has both an integrated carry handle and rivets.

In some embodiments, a relatively rigid material, such as a polypropylene or polyethylene board, may be positioned under the first and second textile bodies 170, 175 to help maintain the shape of the panel 130. In such embodiments, the first textile body 170 may be joined to the relatively rigid material to transfer at least some of the forces imposed upon the carry handle 145 to the relatively rigid material. With reference to FIGS. 11 and 12, when the panel 130 includes a relatively rigid material positioned under the first textile body 170, the first textile body 170 may be joined by mechanical fasteners 225, such as rivets, screws, staples, and so on, or by any other suitable joining method, including, but not limited to, by bonding or gluing.

Figure 13:
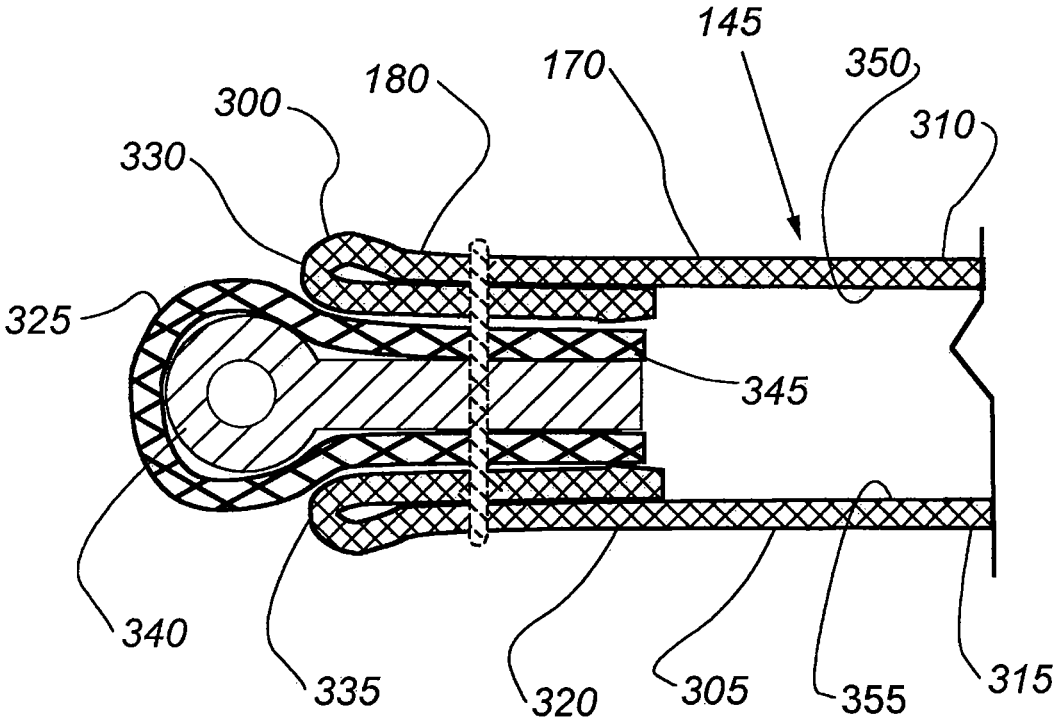
FIG. 13 shows a schematic, partial cross-section view of one embodiment of a carry handle, viewed along line 13-13 in FIG. 2.
Figure 14:
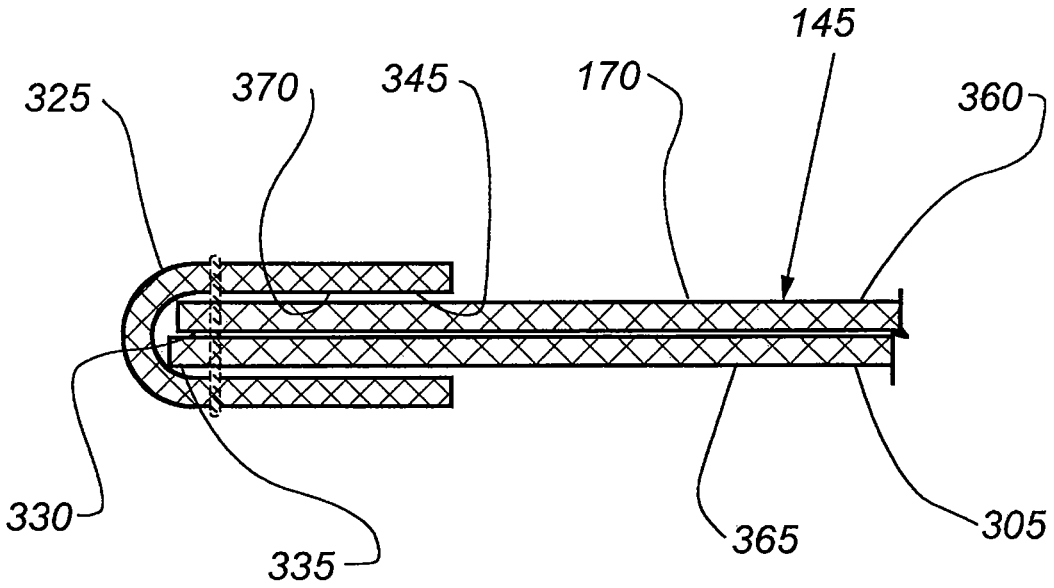
FIG. 14 shows a schematic, partial cross-section view of another embodiment of a carry handle, viewed along line 14-14 in FIG. 2.

FIGS. 13 and 14 show schematic partial cross-section views of additional examples of possible ways to form the carry handle 145. While these views only show one edge 300 of the carry handle 145, the edge of the carry handle 145 that is distal this edge 300 may be formed in a similar manner. Thus, the following description is applicable to edge of the carry handle 145 distal the edge 300 shown in FIGS. 13 and 14.

With reference to FIG. 13, the carry handle 145 may be formed using the first textile body 170 and a third textile body 305. The first textile body 170 may define a first outer surface 310, such as the upper surface, of the grip for the carry handle 145, and the third textile body 305 may define a second outer surface 315, such as the lower surface, of the grip for the carry handle 145. As described above in more detail, the first textile body 170 may further include first and second end portions 185, 190 that define at least portions of the perimeter edge 140 of the panel 130. Further, as described in more detail above, the panel 130 associated with the first textile body 170 may include the second textile body 175. The second textile body 175 in conjunction with the first textile body 170 may collectively define the outer surface 160 of the panel 130.

The third textile body 305 may include a grip portion 320 to define, in conjunction with the first textile body 170, the grip of the carry handle 145. The grip portion 320 for the third textile body 305 may correspond to, or otherwise match in shape, the grip portion 180 of the first textile body 170. The third textile body 305, like the first textile body 170, may further include first and second portions (not shown) with the grip portion 320 positioned between the first and second portions. The first and second portions of the third textile body 305, when present, may generally correspond to, other otherwise match, the shape of the first and second portions of the first textile body 170. In some embodiments, however, the first and second portions of the third textile body 305 may extend only under a portion of the respective first and second portions 185, 190 of the first textile body 170. In such embodiments, one or more edges of the first and second portions of the third textile body 305 may not extend to the perimeter edge 140 of the panel 130.

With continued reference to FIG. 13, an edge fabric 325 may be positioned along each edge 330, 335 of at least the grip portions 180, 320 of the first and third textile bodies 170, 305. The edge fabric 325 could also be positioned along at least portion of the edges of the first and second portions of either, or both, of the first and third textile bodies 170, 305. The edge fabric 325 may be configured to define a substantially enclosed space for receiving a stiffening element 340 (which may also be considered as a rigid or semi-rigid element), such as a polyvinyl chloride (PVC) pipe, a steel or carbon fiber wire, and so on. The stiffening element 340 may help to maintain the shape of the grip of the carry handle 145 defined by the first and third textile bodies 170, 305.

With continued reference to FIG. 13, the edge fabric 325 may be folded into a C- or U-shape to define the enclosed space for the stiffening element 340. The ends 345 of the edge fabric 325 may be positioned between the inner facing surfaces 350, 355 of the first and third textile bodies 170, 305. A portion of the edge fabric 325 may extend beyond the edges 330, 335 of the first and third textile bodies 170, 305. This portion may include the enclosed space that receives the optional stiffening element 340. The end portions of the first and third textile bodies 170, 305, proximate the edge fabric 325, may be folded into a C- or U-shape to define the curved edges 330, 335 for the first and second textile bodies 170, 305. With these end portions of the first and third textile bodies 170, 305 folded, the stiffening element 340 (if any) positioned within the enclosed space, and the ends 345 of the folded edge fabric 325 positioned between the inner facing surfaces 350, 355 of the first and third textile bodies 170, 305, the edge fabric 325, the first textile body 170, and the third textile body 305 may be sewn together, or otherwise suitably joined. Like the first and second textile bodies 170, 175, the third textile body 305 and the edge fabric 325 may be formed from a robust woven textile, such as nylon, polyester, Ramie or the like.

FIG. 14 shows a handle construction similar to the construction shown in FIG. 13. Like the construction in FIG. 13, the carry handle 145 shown in FIG. 14 includes the first textile body 170, the third textile body 305, and an edge fabric 325. The primary difference between these two carry handles 145 arises from how the edge fabric 325 is joined to the first and third textile bodies 170, 305. In the embodiment shown schematically in FIG. 14, the edge fabric 325 is folded into a C- or U-shape, similar to the edge fabric 325 in FIG. 13. The ends 345 of the edge fabric 325, however, are positioned over the outer facing surfaces 360, 365 of the first and third textile bodies 170, 305. Thus, the edges 330, 335 of the first and third textile bodies 170, 305 are positioned between an inner facing surface 370 of the edge fabric 325. Further, unlike the construction shown in FIG. 13, the end portions of the first and third textile bodies 170, 305 are not folded (i.e., they remain straight). Once the edges 330, 335 of the first and third textile bodies 170, 305 are positioned as shown in FIG. 14, the edge fabric 325, the first textile body 170, and third textile body 305 may be sewn together, or otherwise suitably joined. While no stiffening element 340 is shown in FIG. 14, a stiffening element 340 could be positioned within the curved portion of the edge fabric 325, if desired.

While the foregoing examples demonstrate some potential ways to construct the carry handle 145 using textile fabrics, these examples are intended only to be illustrative and not limiting. As such, other techniques or constructions may be used to create the carry handle 145 when formed using at least the first textile body fabric.

Figure 15:
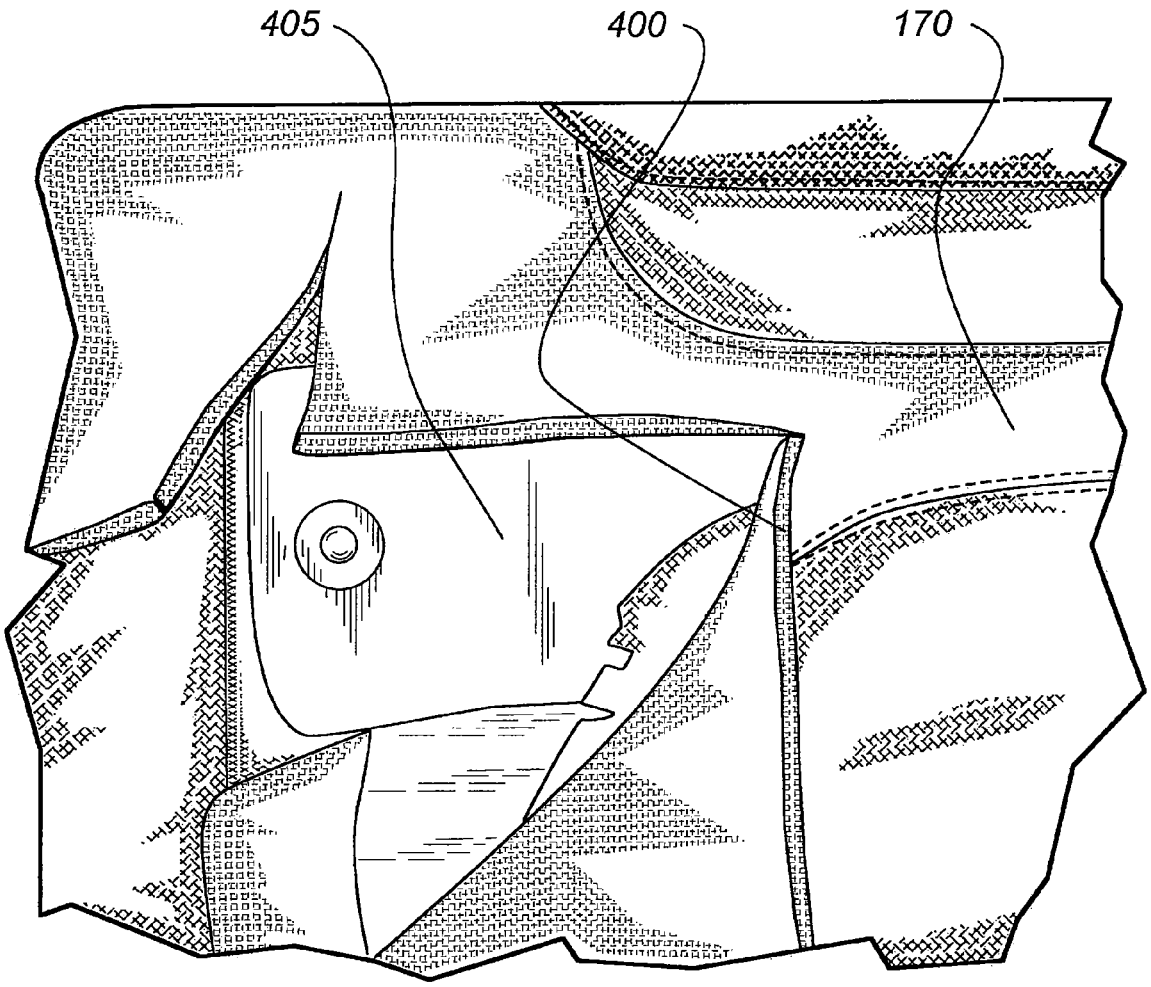
FIG. 15 shows a picture of a luggage case that is cut apart to show some of the materials or components that may be positioned between first and third textile bodies defining a carry handle.
Figure 16:
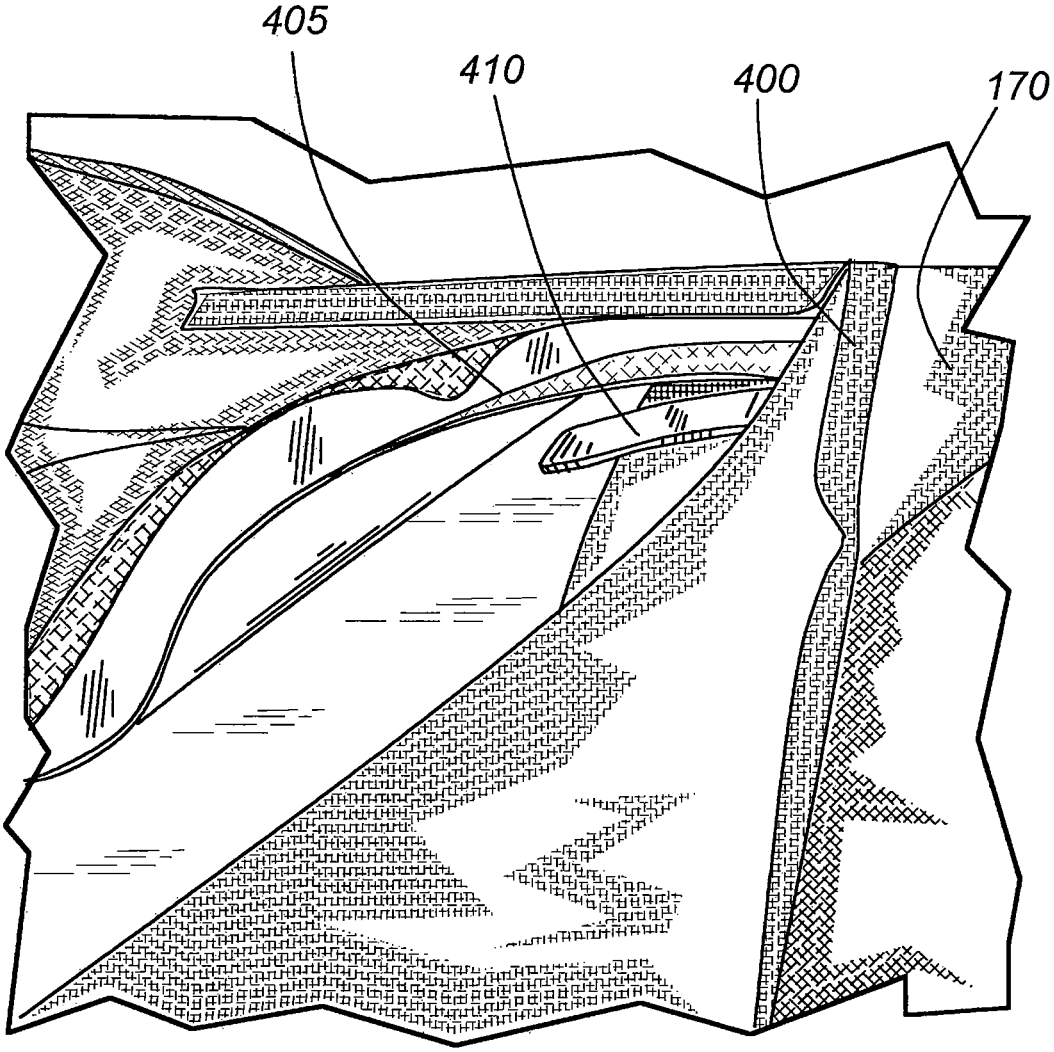
FIG. 16 shows another picture of the luggage case shown in FIG. 15, which is cut apart to show some of the materials or components that may be positioned between the first and third textile bodies defining the carry handle.

Additional materials or components may be placed between the first and third textile bodies 170, 305, if desired. These additional materials or components may be used to help maintain the shape of the carry handle 145, to provide additional structural support for the handle, or to enhance the comfort for a user. FIGS. 15 and 16 show pictures of a luggage case that is cut apart to show some of the materials or components that may be positioned between the first and third textile bodies 170, 305. For example, ethylene vinyl acetate (EVA) foam 400 may joined to the inner facing surfaces of either, or both, of the first and third textile bodies 170, 305. The EVA foam 400 may create a more comfortable grip for a user. The EVA foam 400 may be joined to the first and third textile bodies 170, 305 by adhering the EVA foam 400 to the textile bodies 170, 305 or by any other suitable connection method. In some embodiment that include EVA or other foam, the foam may be positioned between the first and third textile bodies 170, 305 without joining the foam to the textile bodies 170, 305.

As another example, a rigid or semi-rigid board 405, such as a high-density polyethylene (HDPE) board, may be positioned between the first and third textile materials 170, 305. The board 405 may extend from one end of the grip to the opposite end of the grip. Within the grip, the board may be shaped to correspond to the shape of the grip portions 180, 320 for the first and third textile bodies 170, 305. The board 405 may help to maintain the shape for the handle and/or may provide structural support for the handle. If desired, the board 405 may be mechanically fastened with fasteners (such as screws, rivets, and so on), or otherwise joined, to other underlying materials to maintain the relative position of the board to the first and third textile bodies 170, 305.

As yet another example, a rigid or semi-rigid plate 410, such as a steel plate, may be positioned between the first and third textile materials 170, 305. Like the board 405, the plate 410 may extend from one end of the grip to the opposite end of the grip. Also like the board 405, the plate 410 may help to maintain the shape for the handle and/or may provide structural support for the handle.

The foregoing examples are merely illustrative of some components or materials that may be positioned between the first and third textile bodies. Some or all of these materials may or may not be positioned between the first and third textile bodies. Further, other materials or components may or may not be positioned between the first and third textile bodies, such as cardboards, foams other than EVA foams, other fabrics, and so on. Further, in some embodiments, there may be no additional components or materials positioned between the first textile bodies.

Figure 8:
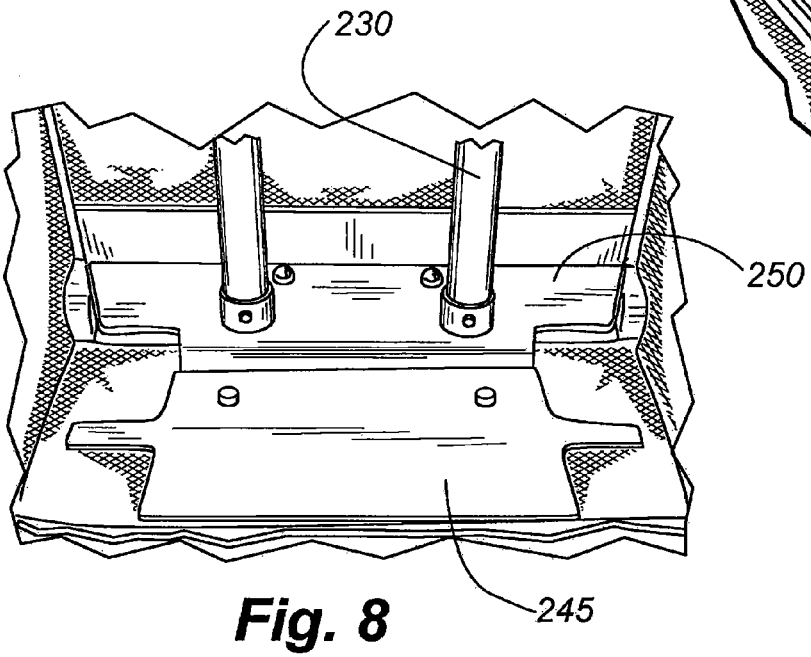
FIG. 8 is a partial perspective view of the luggage case of FIG. 1, showing an interior view of the bottom panel to which is mounted the wheels shown in FIG. 6.
Figure 9:
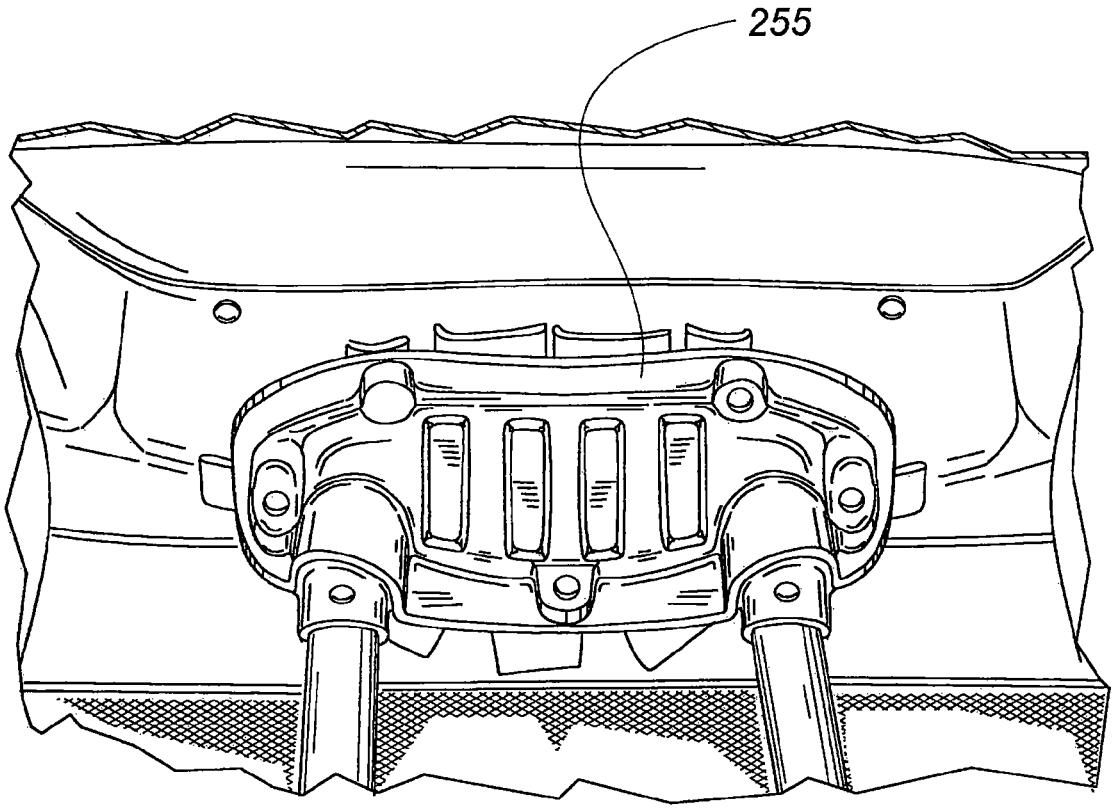
FIG. 9 shows the upper telescopic wheel handle mounting housing as seen from the inside of the luggage case.

Reducing the weight of the luggage may be further enhanced with other modifications to the luggage case 100. More particularly, the luggage case 100 may constructed of materials that further enhance its lightweight impression. For example, in contrast with conventional luggage cases, the down tubes 230 (shown in FIG. 8) that hold the telescoping rods 235 for the telescopic handle 240 may be made aluminum instead of the typical steel, which saves a certain amount of weight. Also the bottom board 245 may be a single honeycomb polymer board. This polymer board may be attached to a monolithic wheel bracket and kick plate 250. With reference to FIG. 9, the housing 255 used to hold the grip portion of the telescopic handle 240 may be a punctured wheel housing type. Such a housing 255 may result in a light luggage case since it may weigh less than the typical, more complex attachment mechanisms used in conventional luggage cases.

Lastly, a higher quality steel may be used to form the thin perimeter wire hoops 155 around the carry handle-bearing panels and around the other panels 130 of the luggage case 100. This permits the diameter of that wire to be reduced, resulting it in a further incremental weight saving. Other materials and constructions may also be used to make the hoop 155, such as an extruded polymer bent into the hoop shape during extrusion or in a post-forming step. The hoop 155 may also be made of one piece, such as by injection molding or stamping from a preformed sheet so long as the sheet panel is sufficiently stiff to resist collapse when subjected to the pulling forces from the first textile body attached to the perimeter of the stiff panel. Alternately, the perimeter hoop could be made of different separate pieces (e.g., injection molded corners with straight pultruded sides).

The above-described constructions may reduce the weight of the upright luggage case compared to conventionally constructed luggage cases. In particular, all things being equal, it is believe that the incorporating a handle into a textile body that forms at least a portion of the outer surface of a panel (e.g., a side panel and/or a top panel) may contribute to a substantial weight saving over an equivalently sized but conventionally constructed case with rigidifying perimeter or corrugated or honeycomb frame members.

All directional references (e.g., upper, lower, upward, downward, left, right, leftward, rightward, top, bottom, above, below, vertical, horizontal, clockwise, and counterclockwise) are only used for identification purposes to aid the reader's understanding of the embodiments of the present invention, and do not create limitations, particularly as to the position, orientation, or use of the invention unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other.

In some instances, components are described with reference to "ends" having a particular characteristic and/or being connected with another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. Luggage, comprising:

a first panel including a perimeter edge;

the first panel defining at least a portion of an outer surface of the luggage;

the first panel including a first textile body and a second textile body;

the first textile body defining at least a portion of an outer surface of the first panel;

the first textile body defining at least a portion of the perimeter edge of the first panel;

the first textile body including a grip portion formed as part of the first textile body, the grip portion of the first textile body defining a first surface of a grip of a carry handle; and the second textile body joined to the first textile body and including a grip portion formed as part of the second textile body, the grip portion of the second textile body defining a second surface of the grip of the carry handle.

2. The luggage of claim 1, wherein the first textile body further includes a first portion and a second portion, and the grip portion of the first textile body is positioned between the first and second portions.

3. The luggage of claim 2, wherein the first and second portions define the at least a portion of the perimeter edge of the first panel.

4. The luggage of claim 2, wherein the first portion includes an edge that defines a width of the first portion, the grip portion includes a longitudinal axis, and the longitudinal axis of the grip portion is approximately transverse to the edge of the first portion.

5. The luggage of claim 2, wherein the first portion includes an edge that defines a width of the first portion, the grip portion includes a longitudinal axis, and the longitudinal axis of the grip is positioned at an angle relative to the edge of the first portion.

6. The luggage of claim 1, wherein the first panel further includes a third textile body, the third textile body defines another portion of the outer surface of the first panel, and the third textile body defines at least a portion of the perimeter edge of the first panel.

7. The luggage of claim 6, wherein the first textile body is joined to the third textile body.

8. The luggage of claim 6, wherein the first textile body and the third textile body collectively define substantially the entire outer surface of the first panel.

9. Luggage, comprising:

a first panel including a perimeter edge;

the first panel defining at least a portion of an outer surface of the luggage;

the first panel including a first textile body, a second textile body, and a third textile body joined to the first textile body;

the first textile body defining at least a portion of an outer surface of the first panel;

the second textile body defining another portion of the outer surface of the first panel;

the first textile body and the second textile body collectively defining substantially the entire outer surface of the first panel;

the first textile body defining at least a portion of the perimeter edge of the first panel;

the second textile body defining at least a portion of the perimeter edge of the first panel;

the first textile body including a grip portion defining a first outer surface of a grip of a carry handle; and the third textile body including a grip portion defining a second outer surface of the grip of the carry handle.

10. The luggage of claim 9, wherein the first outer surface comprises an upper surface, and the second outer surface comprises a lower surface.

11. The luggage of claim 1, further comprising a hoop joined to the first panel proximate the perimeter edge of the first panel.

12. The luggage of claim 1, wherein the perimeter edge of the first panel is substantially rectangular.

13. The luggage of claim 1, further comprising a board positioned proximate to the first textile body.

14. The luggage of claim 1, further comprising a second panel joined to the first panel proximate a portion of the perimeter edge of the first panel.

15. Luggage, comprising, a first panel including a perimeter edge;

the first panel defining at least a portion of an outer surface of the luggage;

the first panel including a first textile body and a second textile body joined to the first textile body;

the first textile body defining at least a portion of an outer surface of the first panel;

the first textile body defining at least a portion of the perimeter edge of the first panel;

the first textile body including a grip portion defining a first surface of a grip of a carry handle;

the second textile body including a grip portion defining a second surface of the grip of the carry handle; and an edge fabric joined to the first and second textile bodies proximate edges of the first and second textile bodies, the edge fabric extending along at least a portion of the grip portions of the first and second textile bodies.

16. The luggage of claim 15, further comprising a stiffening element positioned within a substantially enclosed space defined by the edge fabric.

17. The luggage of claim 16, wherein the stiffening element comprises a polyvinyl chloride pipe.

18. The luggage of claim 1, wherein the first textile body comprises at least a first edge and a second edge that are positioned along the portion of the perimeter edge of the first panel.

19. The luggage of claim 18, wherein the first edge of the first textile body is substantially orthogonal to the second edge of the first textile body.

20. The luggage of claim 18, wherein the first edge of the first textile body is positioned at an angle relative to the second edge of the first textile body.

21. The luggage of claim 18, wherein said portion of the perimeter edge of the first panel comprises a corner of the first panel.

22. Luggage, compromising:

a first panel including a perimeter edge;

the first panel defining at least a portion of an outer surface of the luggage;

the first panel including a first textile body and a second textile body joined to the first textile body;

the first textile body defining at least a portion of an outer surface of the first panel;

the first textile body defining at least a portion of the perimeter edge of the first panel;

the first textile body including a grip portion defining a first surface of a grip of a carry handle;

the second textile body including a grip portion defining a second surface of the grip of the carry handle;

the first textile body comprises at least a first edge and a second edge that are positioned along the portion of the perimeter edge of the first panel; and wherein the first textile body comprises a varying width with a width of the grip portion of the first textile body being less than a width of a portion of the first textile body that is proximate to the first edge of the first textile body.

23. The luggage of claim 1, wherein the first textile body comprises a varying width with a width of the grip portion of the first textile body being less than a width of a portion of the first textile body that is proximate to the perimeter edge of the first panel.

24. The luggage of claim 1, wherein the first textile body includes a first edge that is proximate to the perimeter edge of the first panel, and a width of the first textile body at the first edge is greater than a width of a central portion of the first textile body.

* * * * *